US009601259B2

(12) United States Patent
Ozawa et al.

(10) Patent No.: US 9,601,259 B2
(45) Date of Patent: Mar. 21, 2017

(54) ELECTRONIC COMPONENT

(71) Applicant: MURATA MANUFACTURING CO., LTD., Kyoto (JP)

(72) Inventors: Takeru Ozawa, Nagaokakyo (JP); Kaori Takezawa, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/295,476

(22) Filed: Jun. 4, 2014

(65) Prior Publication Data

US 2015/0009003 A1 Jan. 8, 2015

(30) Foreign Application Priority Data

Jul. 3, 2013 (JP) ..... 2013-139837

(51) Int. Cl.
*H01F 27/29* (2006.01)
*H01F 5/00* (2006.01)
*H01F 17/00* (2006.01)

(52) U.S. Cl.
CPC ..... *H01F 27/292* (2013.01); *H01F 17/0013* (2013.01)

(58) Field of Classification Search
CPC ..... H01F 5/003; H01F 5/04; H01F 17/0006; H01F 17/0013; H01F 27/2804;
(Continued)

(56) References Cited

U.S. PATENT DOCUMENTS 4,803,453 A * 2/1989 Tomono ..... H01F 41/046 336/183
2005/0118969 A1* 6/2005 Shoji ..... H04B 15/02 455/213
(Continued)

FOREIGN PATENT DOCUMENTS

CN 102881402 A 1/2013
JP 2005-191469 A 7/2005
(Continued)

OTHER PUBLICATIONS

An Office Action; "Notification of Reasons for Rejection," issued by the Japanese Patent Office on May 12, 2015, which corresponds to Japanese Patent Application No. 2013-139837 and is related to U.S. Appl. No. 14/295,476; with English language translation.
(Continued)

*Primary Examiner* — Mangtin Lian
(74) *Attorney, Agent, or Firm* — Studebaker & Brackett PC

(57) ABSTRACT

An electronic component has a laminate including a plurality of laminated insulator layers, the laminate having a top surface and a mounting surface positioned in a first direction perpendicular to a direction of lamination. The direction of lamination is a direction in which the plurality of the insulator layers are laminated. First and second external electrodes are positioned on the mounting surface rather than on the top surface. The first and second external electrodes including first and second Ni-plating films and first and second Sn-plating films provided thereon, respectively. A first total thickness of the first Ni-plating film and the first Sn-plating film and/or a second total thickness of the second Ni-plating film and the second Sn-plating film are/is 11.6 μm or more, respectively. The first and/or second
(Continued)

Ni-plating films are/is 1.37 times or more as thick as the first and/or second Sn-plating films, respectively.

8 Claims, 10 Drawing Sheets

(58) Field of Classification Search
CPC .... H01F 27/2828; H01F 27/29; H01F 27/292; H01F 27/2852; H01F 2027/2809
USPC ..... 336/200, 192, 234
See application file for complete search history.

(56) References Cited

U.S. PATENT DOCUMENTS

| | | | | |
|---|---|---|---|---|
| 2007/0040163 | A1* | 2/2007 | Okuzawa | H01F 27/292 257/31 |
| 2010/0026443 | A1* | 2/2010 | Yan et al. | 336/234 |
| 2012/0018205 | A1* | 1/2012 | Sato et al. | 174/260 |
| 2012/0019978 | A1* | 1/2012 | Yoshida | H01C 7/18 361/301.4 |
| 2013/0015937 | A1 | 1/2013 | Seko | |
| 2013/0062994 | A1 | 3/2013 | Ogawa et al. | |
| 2014/0145815 | A1* | 5/2014 | Ishii | H01F 17/0013 336/200 |

FOREIGN PATENT DOCUMENTS

| | | | |
|---|---|---|---|
| JP | 2008-300769 | A | 12/2008 |
| JP | 2012-028456 | A | 2/2012 |
| JP | 2012-079870 | A | 4/2012 |
| JP | 2012-199353 | A | 10/2012 |
| JP | 2013-038392 | A | 2/2013 |

OTHER PUBLICATIONS

An Office Action; "Notification of Reason for Rejection," issued by the Japanese Patent Office on Sep. 8, 2015, which corresponds to Japanese Patent Application No. 2013-139837 and is related to U.S. App. No. 14/295,476; with English language translation.

* cited by examiner

ELECTRONIC COMPONENT

CROSS-REFERENCE TO RELATED APPLICATION

This application claims benefit of priority to Japanese Patent Application No. 2013-139837 filed on Jul. 3, 2013, the entire content of which is incorporated herein by reference.

TECHNICAL FIELD

The present disclosure relates to electronic components, for example, an electronic component including a laminate of multiple insulator layers.

BACKGROUND

As a conventional electronic component, an electronic component disclosed in, for example, Japanese Patent Laid-Open Publication No. 2012-79870 is known. FIG. 12 is an external oblique view of the electronic component 510 disclosed in Japanese Patent Laid-Open Publication No. 2012-79870. In FIG. 12, the direction of lamination will be defined as a y-axis direction. When the electronic component 510 is viewed in a plan view in the y-axis direction, the direction in which the long side of the electronic component 510 extends will be defined as an x-axis direction, and the direction in which the short side of the electronic component 510 extends will be defined as a z-axis direction.

The electronic component 510 is, for example, a laminated chip inductor including a laminate 512 and external electrodes 514*a* and 514*b*. The laminate 512 is in the form of a rectangular solid obtained by laminating a plurality of rectangular insulator layers in the y-axis direction. Accordingly, the end surfaces of the laminate 512 that are located on opposite sides in the x-axis direction, as well as the top and bottom surfaces located on the positive and negative sides, respectively, in the z-axis direction, are planes formed by a series of outer edges of the insulator layers.

Furthermore, the external electrode 514*a* is positioned in the laminate 512 along both the bottom surface on the negative side in the z-axis direction and the end surface on the negative side in the x-axis direction. The external electrode 514*b* is positioned in the laminate 512 along both the bottom surface on the negative side in the z-axis direction and the end surface on the positive side in the x-axis direction.

Incidentally, in the case of the electronic component 510 described in Japanese Patent Laid-Open Publication No. 2012-79870, the laminate 512 might be cracked or chipped when the electronic component 510 is mounted on a circuit board. More specifically, when the electronic component 510 is produced, a plurality of large-sized ceramic green sheets are laminated to obtain a mother laminate, and the mother laminate is then cut into a plurality of laminates 512. Accordingly, the end, top, and bottom surfaces of the laminate 512 are formed by cutting the mother laminate. Therefore, depending on the accuracy of cutting the mother laminate, the parallel relationship between the top and bottom surfaces might become slightly impaired.

The external electrodes 514*a* and 514*b* are positioned in the bottom surface of the laminate 512, as mentioned earlier. On the other hand, when the electronic component 510 is mounted on the board, the top surface of the laminate 512 is sucked and held by a suction nozzle and then attached to the board. Therefore, in the case where the top and bottom surfaces are not parallel, when the suction nozzle contacts the top surface of the laminate 512, the suction nozzle presses a part of the top surface. As a result, the top surface of the laminate 512 might be cracked or chipped. In addition, if the laminate 512 is tilted by the top surface thereof being pressed in part by the suction nozzle, the bottom surface of the laminate 512 strongly contacts a land electrode of the circuit board on which the electronic component 510 is mounted. As a result, the bottom surface of the laminate 512 might be cracked or chipped.

SUMMARY

An electronic component according to an embodiment of the present disclosure includes a laminate including a plurality of laminated insulator layers. The laminate has a top surface and a mounting surface positioned in a first direction perpendicular to a direction of lamination. The direction of lamination is a direction in which the plurality of the insulator layers are laminated. First and second external electrodes are positioned on the mounting surface rather than on the top surface. The first and second external electrodes include first and second Ni-plating films and first and second Sn-plating films provided thereon, respectively. A first total thickness of the first Ni-plating film and the first Sn-plating film and/or a second total thickness of the second Ni-plating film and the second Sn-plating film are/is 11.6 μm or more, respectively. The first and/or second Ni-plating films are/is 1.37 times or more as thick as the first and/or second Sn-plating films, respectively.

DETAILED DESCRIPTION

Hereinafter, an electronic component according to an embodiment of the present disclosure will be described.

Configuration of Electronic Component

Figure 1:
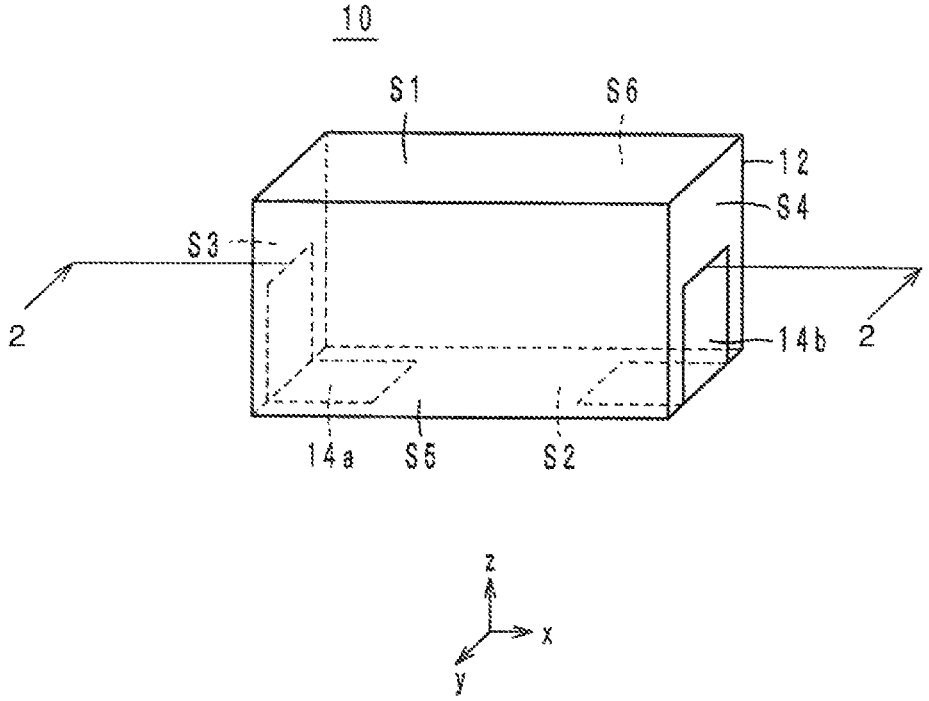
FIG. 1 is an external oblique view of an electronic component according to an embodiment.
Figure 2A:
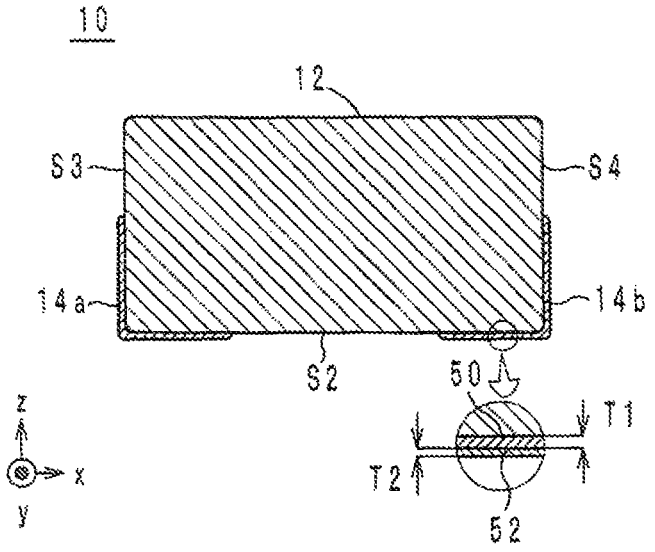
FIG. 2A is a cross-sectional structure view of the electronic component taken along line 2-2 of FIG. 1.
Figure 3:
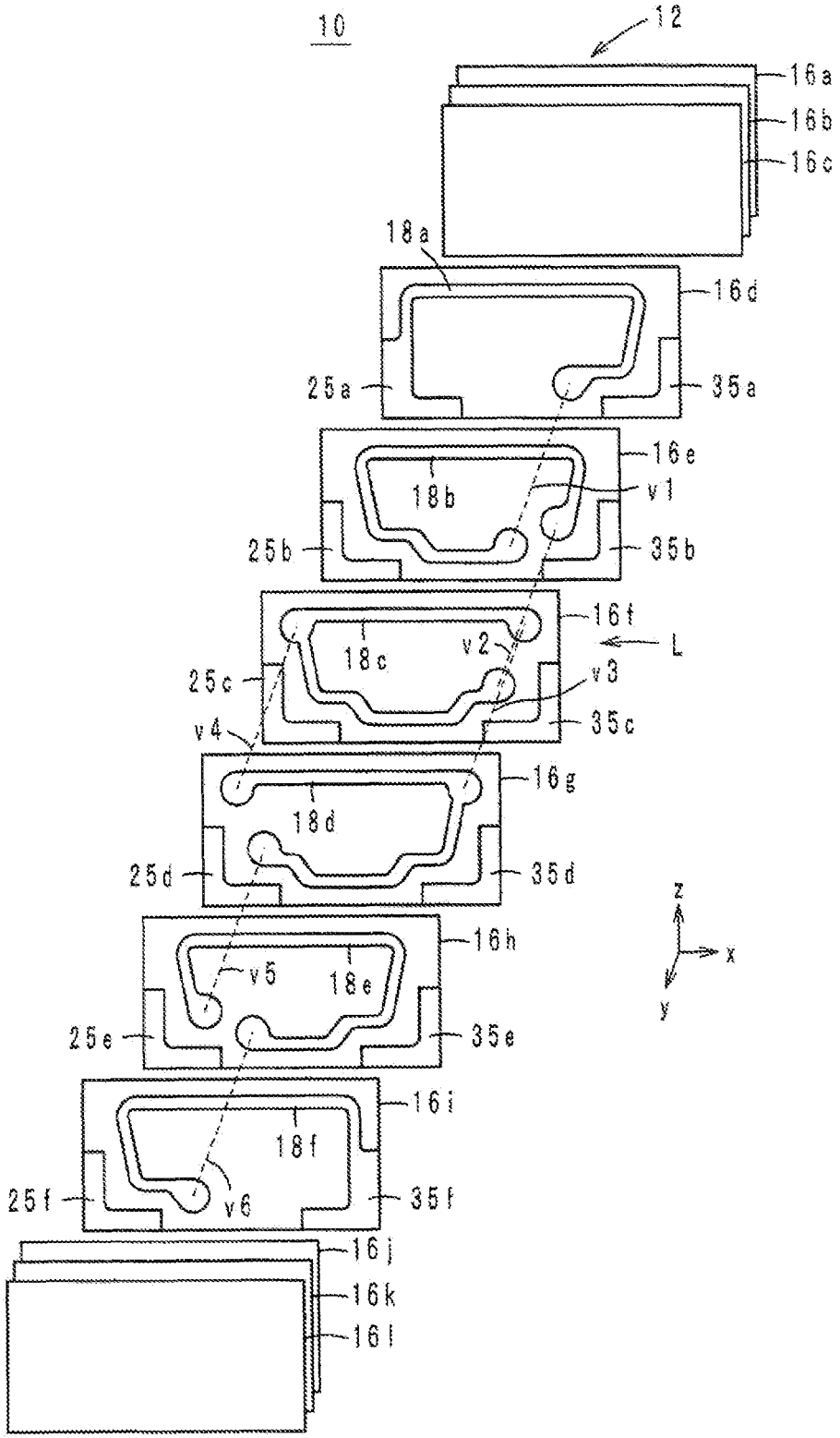
FIG. 3 is an exploded oblique view of the electronic component in FIG. 1.

The configuration of the electronic component according to the embodiment will be described below with reference to the drawings. FIG. 1 is an external oblique view of the electronic component 10 according to the embodiment. FIG. 2A is a cross-sectional structure view of the electronic component 10 taken along line 2-2 of FIG. 1. FIG. 3 is an exploded oblique view of the electronic component 10 in FIG. 1. In the following, the direction of lamination of the electronic component 10 will be defined as a y-axis direction. In addition, when viewed in a plan view in the y-axis direction, the direction in which the long side of the electronic component 10 extends will be defined as an x-axis direction, and the direction in which the short side of the electronic component 10 extends will be defined as a z-axis direction.

As shown in FIGS. 1 through 3, the electronic component 10 includes a laminate 12, external electrodes 14*a* and 14*b*, and a coil L (not shown in FIGS. 1 and 2).

The laminate 12 is in the form of a rectangular solid, for example, obtained by laminating a plurality of insulator layers 16*a* to 16*l* in this order, from the negative side to the positive side in the y-axis direction, as shown in FIG. 3. Accordingly, the laminate 12 has a top surface S1, a bottom surface S2, end surfaces S3 and S4, and side surfaces S5 and S6. The top surface S1 is a surface of the laminate 12 that is located on the positive side in the z-axis direction. The bottom surface S2 is a surface of the laminate 12 that is located on the negative side in the z-axis direction, and serves as a mounting surface to face a circuit board when the electronic component 10 is mounted on the circuit board. The top surface S1 is formed by a series of the long sides (i.e., outer edges) of the insulator layers 16 on the positive side in the z-axis direction, and the bottom surface S2 is formed by a series of the long sides (i.e., outer edges) of the insulator layers 16 on the negative side in the z-axis direction. The end surfaces S3 and S4 are surfaces of the laminate 12 that are located on the negative and positive sides, respectively, in the x-axis direction. The end surface S3 is formed by a series of the short sides (i.e., outer edges) of the insulator layers 16 on the negative side in the x-axis direction, and the end surface S4 is formed by a series of the short sides (i.e., outer edges) of the insulator layers 16 on the positive side in the x-axis direction. Moreover, the end surfaces S3 and S4 neighbor the bottom surface S2. The side surfaces S5 and S6 are surfaces of the laminate 12 that are located on the positive and negative sides, respectively, in the y-axis direction.

The insulator layers 16 are in the shape of rectangles or the like, as shown in FIG. 3, and are made of, for example, an insulating material mainly composed of borosilicate glass. In the following, the surfaces of the insulator layers 16 that are located on the positive side in the y-axis direction will be referred to as front faces, and the surfaces of the insulator layers 16 that are located on the negative side in the y-axis direction will be referred to as back faces.

The coil L includes coil conductors 18*a* to 18*f* and via-hole conductors v1 to v6. The coil L substantially has a helical shape which travels from the negative side toward the positive side in the y-axis direction while turning clockwise when viewed in a plan view from the positive side in the y-axis direction. The coil conductors 18*a* to 18*f* are provided on the front faces of the insulator layers 16*d* to 16*i*, so as to overlap with one another in the form of an annular path when viewed in a plan view in the y-axis direction. Each of the coil conductors 18*a* to 18*f* is partially cut out in the path. The coil conductors 18 are made of, for example, a conductive material mainly composed of Ag. In the following, the ends of the coil conductors 18 that are located upstream in the clockwise direction will be simply referred to as the upstream ends, and the ends of the coil conductors 18 that are located downstream in the clockwise direction will be referred to as the downstream ends.

The via-hole conductors v1 to v6 pierce through the insulator layers 16*e* to 16*i*, respectively, in the y-axis direction. The via-hole conductor v1 connects the downstream end of the coil conductor 18*a* to the upstream end of the coil conductor 18*b*. The via-hole conductor v2 connects the downstream end of the coil conductor 18*b* to the upstream end of the coil conductor 18*c*. The via-hole conductor v3 connects the downstream end of the coil conductor 18*c* to the upstream end of the coil conductor 18*d*. The via-hole conductor v4 connects the downstream end of the coil conductor 18*c* to the upstream end of the coil conductor 18*d*. The via-hole conductor v5 connects the downstream end of the coil conductor 18*d* to the upstream end of the coil conductor 18*e*. The via-hole conductor v6 connects the downstream end of the coil conductor 18*e* to the upstream end of the coil conductor 18*f*. The via-hole conductors v1 to v6 are made of, for example, a conductive material mainly composed of Ag.

The external electrode 14*a* is embedded in the bottom surface S2 and the end surface S3 of the laminate 12 formed by a series of the outer edges of the insulator layers 16*a* to 16*l*, so as to extend across the bottom surface S2 and the end surface S3, as shown in FIG. 1. Accordingly, the external electrode 14*a*, when viewed in a plan view in the y-axis direction, has an L-like shape. The external electrode 14*a* does not extend to the top surface S1. The external electrode 14*a* is formed by laminating external conductors 25*a* to 25*f*, as shown in FIG. 3.

The external conductors 25*a* to 25*f* pierce through the insulator layers 16*d* to 16*i* in the y-axis direction, as shown in FIG. 3, and are electrically connected by lamination. The external conductors 25*a* to 25*f*, when viewed in a plan view in the y-axis direction, have an L-like shape, and are positioned in the corners where the short sides of the insulator layers 16*d* to 16*i* that are located on the negative side in the x-axis direction meet the long sides on the negative side in the z-axis direction. Moreover, the external conductor 25*a* is connected to the upstream end of the coil conductor 18*a*.

Furthermore, the portions of the external conductors 25*a* to 25*f* that are exposed from the laminate 12 are plated with Ni and Sn with a view to obtaining satisfactory solder joints upon mounting, as shown in FIGS. 2 and 3. More specifically, the external electrode 14*a* further includes a Ni-plating film 50 and a Sn-plating film 52 provided on the Ni-plating film 50 over the portions of the external conductors 25*a* to 25*f* that are exposed from the end surface S3 and the bottom surface S2. The total of the thickness T1 of the Ni-plating film 50 and the thickness T2 of the Sn-plating film 52 is from 11.6 μm to 17.7 μm. In addition, the thickness T1 of the Ni-plating film 50 is 1.37 to 2.54 times as much as the thickness T2 of the Sn-plating film 52.

The external electrode 14*b* is embedded in the bottom surface S2 and the end surface S4 of the laminate 12 formed by a series of the outer edges of the insulator layers 16*a* to 16*l*, so as to extend across the bottom surface S2 and the end surface S4, as shown in FIG. 1. Accordingly, the external electrode 14*b*, when viewed in a plan view in the y-axis direction, has an L-like shape. The external electrode 14*b* does not extend to the top surface S1. The external electrode 14*b* is formed by laminating external conductors 35*a* to 35*f*, as shown in FIG. 3.

The external conductors 35*a* to 35*f* pierce through the insulator layers 16*d* to 16*i* in the y-axis direction, as shown in FIG. 3, and are electrically connected by lamination. The external conductors 35*a* to 35*f*, when viewed in a plan view in the y-axis direction, have an L-like shape, and are positioned in the corners where the short sides of the insulator layers 16*d* to 16*i* that are located on the positive side in the x-axis direction meet the long sides on the negative side in the z-axis direction. Moreover, the external conductor 35*f* is connected to the downstream end of the coil conductor 18*f*.

Furthermore, the portions of the external conductors 35*a* to 35*f* that are exposed from the laminate 12 are plated with Ni and Sn with a view to obtaining satisfactory solder joints upon mounting, as shown in FIG. 2A. More specifically, the external electrode 14*b* further includes a Ni-plating film 50 and a Sn-plating film 52 provided on the Ni-plating film 50 over the portions of the external conductors 35*a* to 35*f* that are exposed from the end surface S4 and the bottom surface S2. The total of the thickness T1 of the Ni-plating film 50 and the thickness T2 of the Sn-plating film 52 is from 11.6 μm to 17.7 μm. In addition, the thickness T1 of the Ni-plating film 50 is 1.37 to 2.54 times as much as the thickness T2 of the Sn-plating film 52.

Here, the insulator layers 16*a* to 16*c* and the insulator layers 16*j* to 16*l* are laminated on opposites sides, respectively, of the external electrodes 14*a* and 14*b* in the y-axis direction. Accordingly, the external electrodes 14*a* and 14*b* are not exposed from the side surfaces S5 and S6.

Method for Producing Electronic Component

The method for producing the electronic component 10 according to the present embodiment will be described below with reference to the drawings. FIGS. 4 through 9 are plan views of the electronic component 10 during production.

Figure 4:
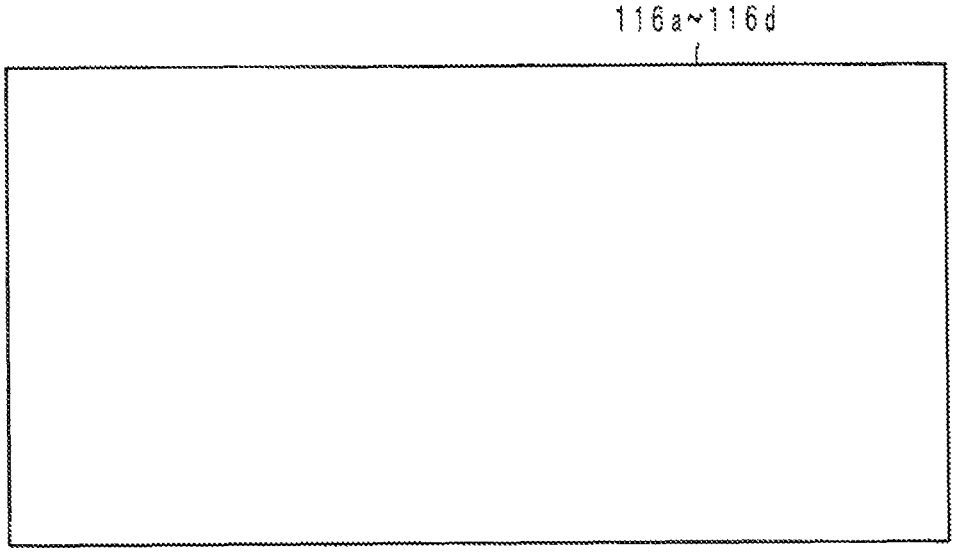
FIG. 4 is a plan view of the electronic component during production.

Initially, an insulating paste mainly composed of borosilicate glass is repeatedly applied by screen printing, thereby forming insulating paste layers 116*a* to 116*d*, as shown in FIG. 4. The insulating paste layers 116*a* to 116*d* are outer insulator layers positioned outside relative to the coil L and serving as insulator layers 16*a* to 16*d*.

Figure 5:
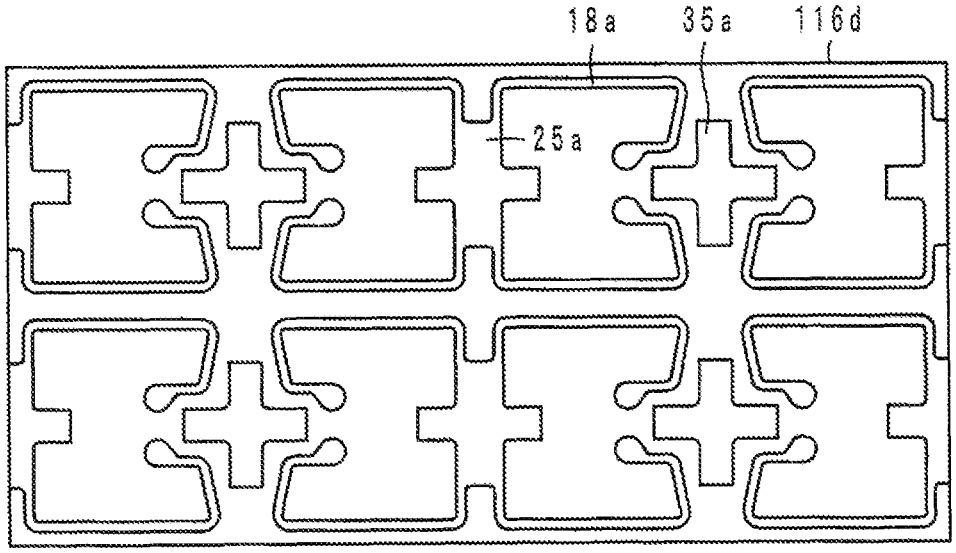
FIG. 5 is a plan view of the electronic component during production

Next, coil conductors 18*a* and external conductors 25*a* and 35*a* are formed by photolithography, as shown in FIG. 5. Specifically, a photosensitive, conductive paste whose main metal component is Ag is applied to the insulating paste layer 116*d* by screen printing, thereby forming a conductive paste layer on the insulating paste layer 116*d*. In addition, the conductive paste layer is irradiated with ultraviolet light or suchlike through a photomask, and developed by an alkaline solution or suchlike. As a result, the external conductors 25*a* and 35*a* and the coil conductors 18*a* are formed on the insulating paste layer 116*d*.

Figure 6:
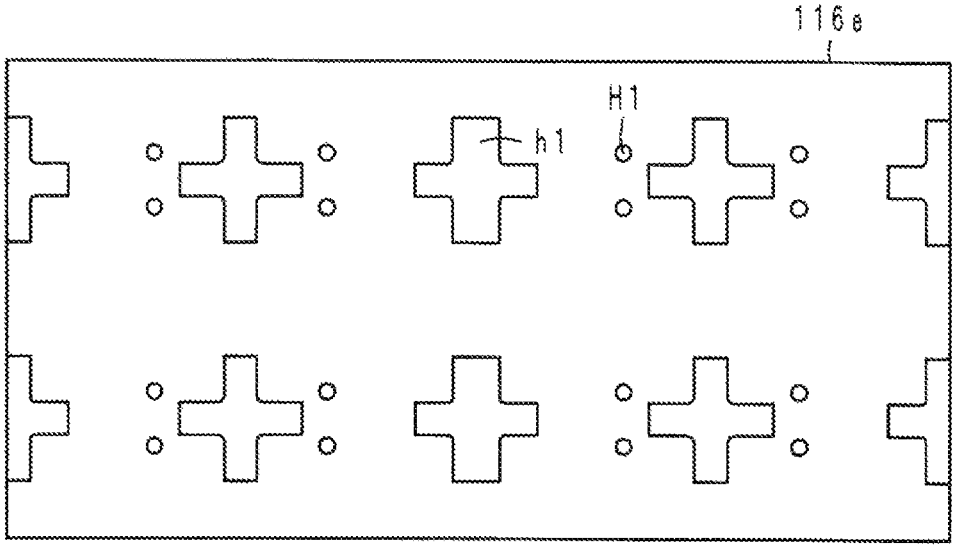
FIG. 6 is a plan view of the electronic component during production.

Next, an insulating paste layer 116*e* with openings h1 and via-holes H1 is formed by photolithography, as shown in FIG. 6. Specifically, a photosensitive, insulating paste is applied to the insulating paste layer 116*d* by screen printing, thereby forming an insulating paste layer on the insulating paste layer 116*d*. In addition, the insulating paste layer is irradiated with ultraviolet light or suchlike through a photomask, and developed by an alkaline solution or suchlike. The insulating paste layer 116*e* is a paste layer serving as an insulator layer 16*e*. The opening h1 is a cross-shaped hole in which two external conductors 25*b* and two external conductors 35*b* are joined.

Figure 7:
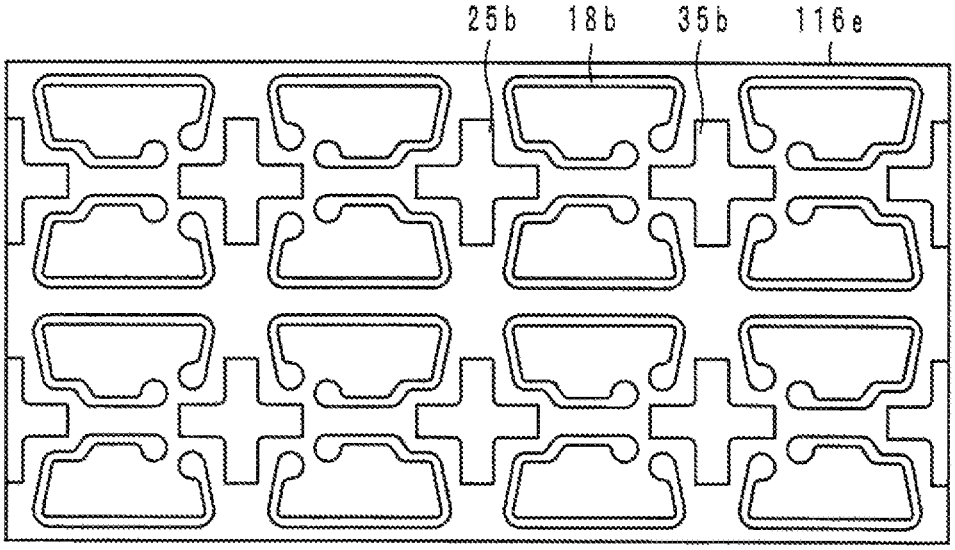
FIG. 7 is a plan view of the electronic component during production.

Next, coil conductors 18*b*, external conductors 25*b* and 35*b*, and via-hole conductors v1 are formed by photolithography, as shown in FIG. 7. Specifically, a photosensitive, conductive paste whose main metal component is Ag is applied to the insulating paste layer 116*e* by screen printing, thereby forming a conductive paste layer on the insulating paste layer 116*e* so as to fill the openings h1 and the via-holes H1. In addition, the conductive paste layer is irradiated with ultraviolet light or suchlike through a photomask, and developed by an alkaline solution or suchlike. As a result, the external conductors 25*b* and 35*b* are formed in the openings h1, the via-hole conductors v1 are formed in the via-holes H1, and the coil conductors 18*b* are formed on the insulating paste layer 116*e*.

Figure 8:
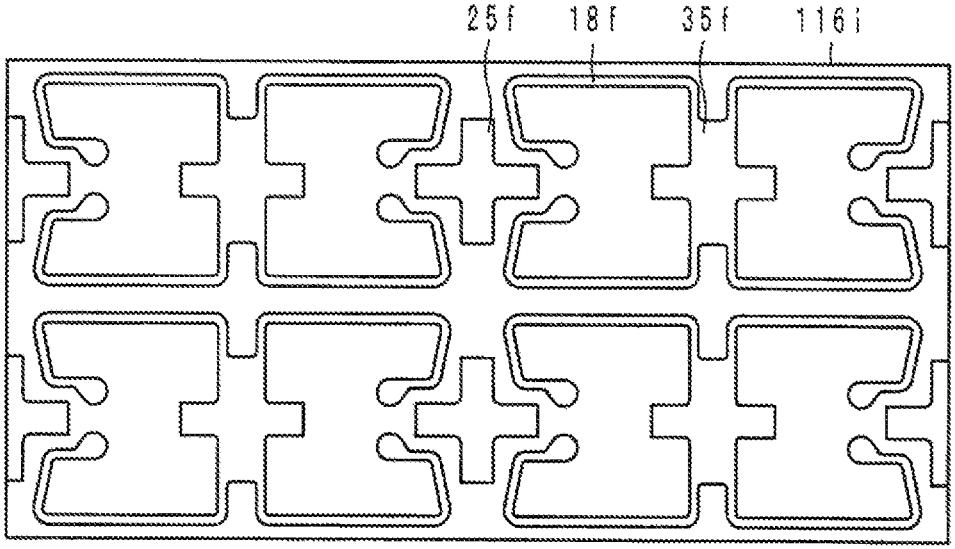
FIG. 8 is a plan view of the electronic component during production.

Thereafter, the same steps as shown in FIGS. 6 and 7 are repeated to form insulating paste layers 116*f* to 116*i*, coil conductors 18*c* to 18*f*, external conductors 25*c* to 25*f* and 35*c* to 35*f*, and via-hole conductors v2 to v6. As a result, the coil conductors 18*f* and the external conductors 25*f* and 35*f* are formed on the insulating paste layer 116*i*, as shown in FIG. 8.

Figure 9:
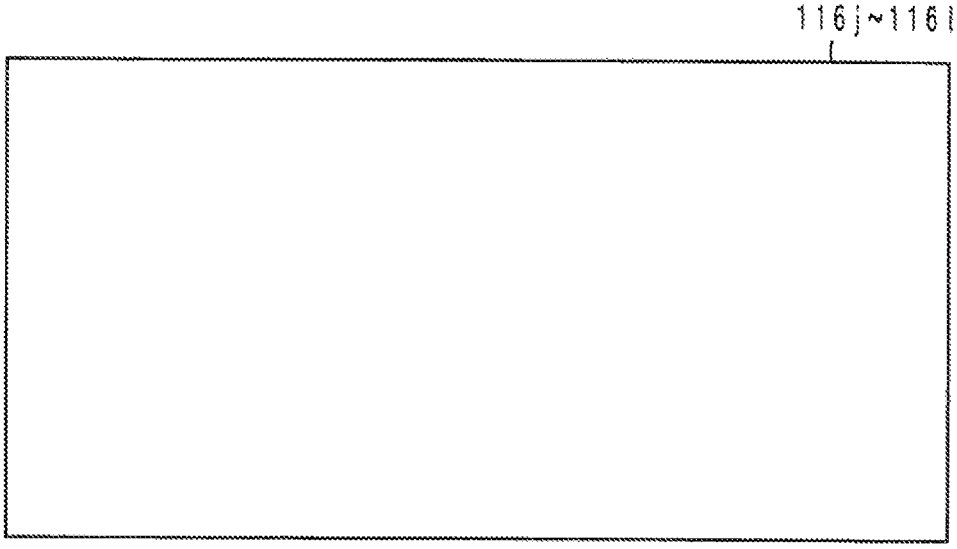
FIG. 9 is a plan view of the electronic component during production.

Next, an insulating paste is repeatedly applied by screen printing, thereby forming insulating paste layers 116*j* to 116*l*, as shown in FIG. 9. The insulating paste layers 116*j* to 116*l* are outer insulator layers positioned outside relative to the coil L and serving as insulator layers 16*j* to 16*l*. Through the above steps, a mother laminate 112 is obtained.

Next, the mother laminate 112 is cut into a plurality of unsintered laminates 12 by dicing or suchlike. In the step of cutting the mother laminate 112, the external electrodes 14*a* and 14*b* are exposed from the laminates 12 at edges made by the cutting.

Next, the unsintered laminates 12 are sintered under predetermined conditions. In addition, the sintered laminates 12 are barreled for beveling.

Lastly, the laminates 12 are plated with Ni where the external electrodes 14*a* and 14*b* are exposed, and thereafter with Sn over the Ni plating film. At this time, the Ni and Sn plating is performed such that the total of the thickness T1 of the Ni-plating film 50 and the thickness T2 of the Sn-plating film 52 is from 11.6 μm to 17.7 μm, and the thickness T1 of the Ni-plating film 50 is 1.37 to 2.54 times as much as the thickness T2 of the Sn-plating film 52. By the foregoing process, the electronic component 10 is completed.

Effects

Figure 10:
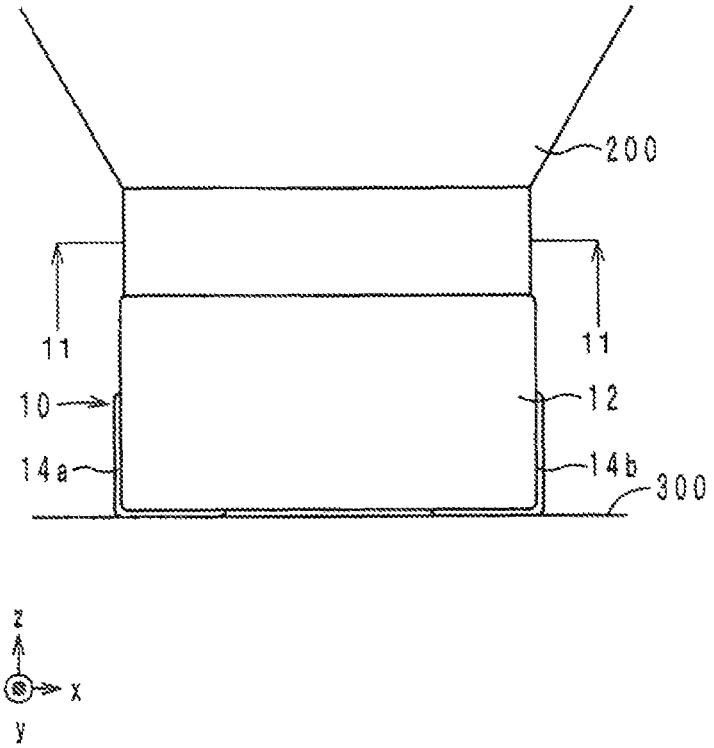
FIG. 10 is a diagram illustrating a nozzle of a mounter mounting the electronic component on a board.
Figure 11:
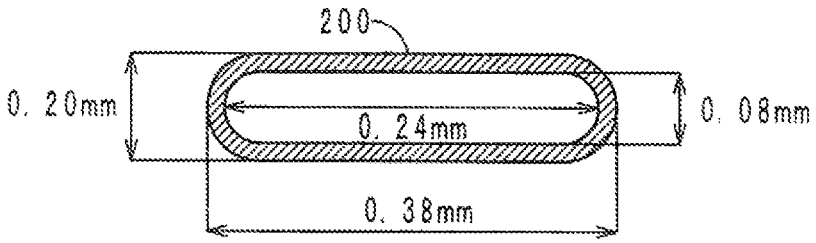
FIG. 11 is a cross-sectional structure view of the nozzle taken along line 11-11 of FIG. 10.
Figure 12:
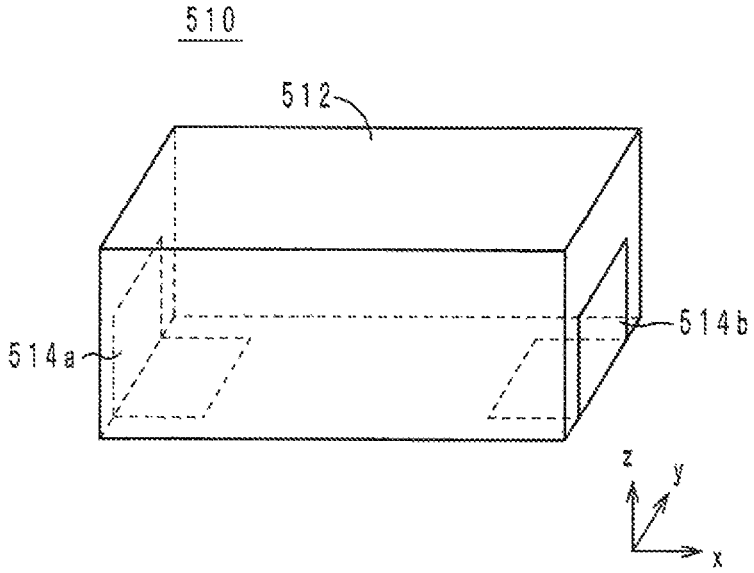
FIG. 12 PRIOR ART
FIG. 12 is an external oblique view of an electronic component disclosed in Japanese Patent Laid-Open Publication No. 2012-79870.

The electronic component 10 according to the present embodiment renders it possible to suppress the occurrence of cracking or chipping in the laminate 12. More specifically, in the electronic component 10, the total of the thickness T1 of the Ni-plating film 50 and the thickness T2 of the Sn-plating film 52 is from 11.6 μm to 17.7 μm, and the thickness T1 of the Ni-plating film 50 is 1.37 to 2.54 times as much as the thickness T2 of the Sn-plating film 52. The present inventors carried out the experimentation as will be described below, and observed that by setting the thickness T1 of the Ni-plating film 50 and the thickness T2 of the Sn-plating film 52 as described above for the external electrodes 14*a* and 14*b*, it is rendered possible to suppress the occurrence of cracking or chipping in the laminate 12. FIG. 10 is a diagram illustrating a nozzle 200 of a mounter mounting an electronic component 10 on a board. FIG. 11 is a cross-sectional structure view of the nozzle 200 taken along line 11-11 of FIG. 10.

First, the present inventors produced first through fifth sample groups of two hundred electronic components 10. The specifications for the first through fifth sample groups are as shown below.

Size (length×width×height) of the first through fifth sample groups: 0.4 mm×0.2 mm×0.2 mm;

Thickness T1 of the Ni-plating film 50 for the first sample group: 6.7 μm;

Thickness T2 of the Sn-plating film 52 for the first sample group: 4.9 μm;

Thickness T1 of the Ni-plating film 50 for the second sample group: 7.4 μm;

Thickness T2 of the Sn-plating film 52 for the second sample group: 4.8 μm;

Thickness T1 of the Ni-plating film 50 for the third sample group: 12.7 μm;

Thickness T2 of the Sn-plating film 52 for the third sample group: 5.0 μm;

Thickness T1 of the Ni-plating film 50 for the fourth sample group: 4.6 μm;

Thickness T2 of the Sn-plating film 52 for the fourth sample group: 4.6 μm;

Thickness T1 of the Ni-plating film 50 for the fifth sample group: 4.4 μm; and Thickness T2 of the Sn-plating film 52 for the fifth sample group: 4.2 μm.

The thickness T1 of the Ni-plating film 50 and the thickness T2 of the Sn-plating film 52 were measured by the following method. Specifically, cross-sections of the first through fifth sample groups were revealed by abrading the electronic components until their thickness in the y-axis direction was reduced to half. For each of the first through fifth sample groups, the thickness T1 of the Ni-plating film 50 and the thickness T2 of the Sn-plating film 52 were measured at the center in the x-axis direction in the cross-section of each of the external electrodes 14*a* and 14*b* on the bottom surface S2.

The present inventors mounted the first through fifth sample groups on boards using the mounter and its nozzle 200, as shown in FIG. 10. The intensity of the stress to be applied to the top surface S1 by the nozzle 200 (impact load) at this time was set at either 13 or 22 newtons [N]. The tip of the nozzle 200 was elliptical, as shown in FIG. 11. For each of the first through fifth sample groups, the present inventors evaluated the number of electronic components cracked or chipped through suction. Table 1 shows the experimentation results.

TABLE 1

| Load (N) | 13 | 22 |
|---|---|---|
| First Sample | 0/200 | 1/200 |
| Second Sample | 1/200 | 2/200 |
| Third Sample | — | 0/200 |
| Fourth Sample | 5/200 | 6/200 |
| Fifth Sample | 3/200 | 9/200 |

According to Table 1, only about zero to two out of the 200 electronic components in each of the first through third sample groups were cracked or chipped. On the other hand, in each of the fourth and fifth sample groups, five or more out of the 200 electronic components were cracked or chipped. Therefore, it can be appreciated that the occurrence of cracking or chipping was suppressed for the first through third sample groups but not sufficiently suppressed for the fourth and fifth sample groups.

Here, for the first sample group, the total of the thickness T1 of the Ni-plating film 50 and the thickness T2 of the Sn-plating film 52 was 11.6 μm, and the thickness T1 of the Ni-plating film 50 was 1.37 times as much as the thickness T2 of the Sn-plating film 52. For the second sample group, the total of the thickness T1 of the Ni-plating film 50 and the thickness T2 of the Sn-plating film 52 was 12.2 μm, and the thickness T1 of the Ni-plating film 50 was 1.54 times as much as the thickness T2 of the Sn-plating film 52. For the third sample group, the total of the thickness T1 of the Ni-plating film 50 and the thickness T2 of the Sn-plating film 52 was 17.7 μm, and the thickness T1 of the Ni-plating film 50 was 2.54 times as much as the thickness T2 of the Sn-plating film 52.

On the other hand, for the fourth sample group, the total of the thickness T1 of the Ni-plating film 50 and the thickness T2 of the Sn-plating film 52 was 9.2 μm, and the thickness T1 of the Ni-plating film 50 was 1.00 times as much as the thickness T2 of the Sn-plating film 52. For the fifth sample group, the total of the thickness T1 of the Ni-plating film 50 and the thickness T2 of the Sn-plating film 52 was 8.6 μm, and the thickness T1 of the Ni-plating film 50 was 1.05 times as much as the thickness T2 of the Sn-plating film 52.

By comparing the first through fifth sample groups, it can be appreciated that the total of the thickness T1 of the Ni-plating film 50 and the thickness T2 of the Sn-plating film 52 for each of the first through third sample groups is greater than that for each of the fourth and fifth sample groups, and it can also be appreciated that, for each of the first through third sample groups, the thickness T1 of the Ni-plating film 50 is significantly greater than the thickness T2 of the Sn-plating film 52. It is conceivable that these features allow the external electrodes 14*a* and 14*b* to absorb the impact caused by the nozzle 200 of the mounter upon the process of mounting, so that the occurrence of cracking or chipping in the laminate 12 is suppressed. From the above experimentation results, it can be appreciated that the total of the thickness T1 of the Ni-plating film 50 and the thickness T2 of the Sn-plating film 52 is preferably from 11.6 μm to 17.7 μm, and the thickness T1 of the Ni-plating film 50 is preferably 1.37 to 2.54 times as much as the thickness T2 of the Sn-plating film 52.

Next, the present inventors produced third and sixth through eighth sample groups of two hundred electronic components 10. The specifications for the sixth through eighth sample groups are as shown below. The specifications for the third sample group have been described earlier, and therefore, any description thereof will be omitted here.

Size (length×width×height) of the sixth through eighth sample groups: 0.4 mm×0.2 mm×0.2 mm;

Thickness T1 of the Ni-plating film 50 for the sixth sample group: 5.3 μm;

Thickness T2 of the Sn-plating film 52 for the sixth sample group: 4.9 μm;

Thickness T1 of the Ni-plating film 50 for the seventh sample group: 4.9 μm;

Thickness T2 of the Sn-plating film 52 for the seventh sample group: 8.9 μm;

Thickness T1 of the Ni-plating film 50 for the eighth sample group: 5.3 μm; and Thickness T2 of the Sn-plating film 52 for the eighth sample group: 13.5 μm.

The present inventors mounted the third and the sixth through eighth sample groups on boards using the mounter and its nozzle 200, as shown in FIG. 10. The intensity of the stress to be applied to the top surface S1 by the nozzle 200 (impact load) at this time was set at 22 N. For each of the third and the sixth through eighth sample groups, the present inventors evaluated the number of electronic components cracked or chipped upon mounting on the boards. Table 2 shows the experimentation results.

TABLE 2

| Load (N) | 22 |
|---|---|
| Third Sample | 0/200 |
| Sixth Sample | 17/200 |
| Seventh Sample | 2/200 |
| Eighth Sample | 3/200 |

According to Table 2, for the sixth sample group for which the thickness T1 of the Ni-plating film 50 is approximately equal to the thickness T2 of the Sn-plating film 52, 17 out of the 200 electronic components were cracked or chipped. As for each of the seventh and eighth sample groups for which the thickness T2 of the Sn-plating film 52 is significantly greater than the thickness T1 of the Ni-plating film 50, the number of electronic components cracked or chipped was reduced to 2 or 3 out of the 200 electronic components.

On the other hand, for the third sample group for which the thickness T1 of the Ni-plating film 50 is significantly greater than the thickness T2 of the Sn-plating film 52, there was no electronic component cracked or chipped. Therefore, from the above experimentation results, it can be appreciated that the occurrence of cracking or chipping in the laminate 12 can be suppressed more effectively by increasing the thickness T1 of the Ni-plating film 50 than by increasing the thickness T2 of the Sn-plating film 52.

Other Embodiments

The present disclosure is not limited to the electronic component 10, and variations can be made within the spirit and scope of the disclosure. More specifically, the electronic component 10 has been described as including the coil L, but it may include a circuit element (e.g., a capacitor) other than the coil.

Figure 2B:
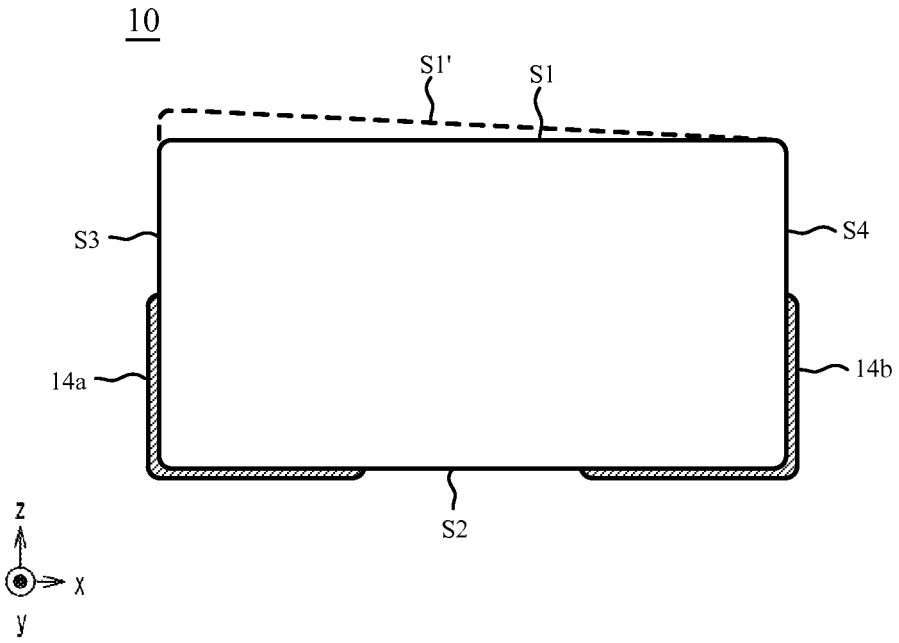
FIG. 2B depicts a variant of the structure shown in FIG. 2A caused by variations in manufacturing.

Note that in the step of cutting the laminate 12, the top surface S1 and the bottom surface S2 might lose their parallel relationship because of manufacturing variations. Accordingly, in the case of the electronic component 10, the top surface S1 and the bottom surface S2 do not have to be parallel to each other. An example of this is depicted in FIG. 2B, where a variant, non-parallel top surface S1' is shown in context with parallel surface S1.

Although the present disclosure has been described in connection with the preferred embodiment above, it is to be noted that various changes and modifications are possible to those who are skilled in the art. Such changes and modifications are to be understood as being within the scope of the disclosure.

What is claimed is:

1. An electronic component comprising:

a laminate including a coil and a plurality of laminated insulator layers, the laminate including:

a first side surface, a second side surface positioned opposite the first side surface in a direction of lamination, the direction of lamination being a direction in which the plurality of the insulator layers are stacked upon one another, and a top surface and a mounting surface positioned opposite the top surface, the mounting surface facing in a first direction perpendicular to the direction of lamination and configured to be mounted on a circuit board;

first and second external electrodes positioned on the mounting surface and not provided on the top surface of the laminate and connected to a first end and a second end of the coil, respectively, the first and second external electrodes including first and second Ni-plating films and first and second Sn-plating films provided thereon, respectively, wherein, the first and second external electrodes include external conductors laminated on one another and pierce through the insulator layers in the direction of lamination, the first and second Ni-plating films are provided on portions of the external conductors that are exposed from the mounting surface of the laminate, a first total thickness of the first Ni-plating film and the first Sn-plating film and/or a second total thickness of the second Ni-plating film and the second Sn-plating film are/is 11.6 μm or more, respectively, and the first and/or second Ni-plating films are/is 1.37 times or more as thick as the first and/or second Sn-plating films, respectively.

2. The electronic component according to claim 1, wherein, the laminate has first and second end surfaces both facing in a second direction perpendicular to both the direction of lamination and the first direction, the first external electrode extends across the mounting surface and the first end surface, and the second external electrode extends across the mounting surface and the second end surface.

3. The electronic component according to claim 1, wherein the first total thickness of the first Ni-plating film and the first Sn-plating film and/or the second total thickness of the second Ni-plating film and the second Sn-plating film are/is 17.7 μm or less, respectively.

4. The electronic component according to claim 1, wherein the first and/or second Ni-plating films are/is 2.54 times or less as thick as the first and/or second Sn-plating film, respectively.

5. The electronic component according to claim 1, wherein the top surface and the mounting surface are not parallel to each other.

6. The electronic component according to claim 1, where the first and second external electrodes are each L-shaped.

7. The electronic component according to claim 1, wherein the laminate has first and second end surfaces both facing in a second direction perpendicular to both the direction of lamination and the first direction, the external conductors of the first external electrode extend across the mounting surface and the first end surface to have an L shape in plan view of the direction of lamination and are exposed from the mounting surface and the first end surface, and the external conductors of the second external electrode extend across the mounting surface and the second end surface to have an L shape in plan view of the direction of lamination and are exposed from the mounting surface and the second end surface.

8. The electronic component according to claim 7, wherein the first Ni-plating film of the first external electrode is provided on the portions of the external conductors of the first external electrode, the portions of the external conductors of the first external electrode being exposed from the mounting surface and the first end surface of the laminate, and the second Ni-plating film of the second external electrode is provided on the portions of the external conductors of the second external electrode, the portions of the external conductors of the second external electrode being exposed from the mounting surface and the second end surface of the laminate.

* * * * *